US011561498B2

(12) United States Patent
Juri et al.

(10) Patent No.: US 11,561,498 B2
(45) Date of Patent: Jan. 24, 2023

(54) CLEANING BLADE, PROCESS CARTRIDGE, AND IMAGE FORMING APPARATUS

(71) Applicants: Keiichiro Juri, Kanagawa (JP); Masahiro Ohmori, Kanagawa (JP)

(72) Inventors: Keiichiro Juri, Kanagawa (JP); Masahiro Ohmori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/646,930

(22) Filed: Jan. 4, 2022

(65) Prior Publication Data

US 2022/0221817 A1 Jul. 14, 2022

(30) Foreign Application Priority Data

Jan. 8, 2021 (JP) ..... JP2021-002232

(51) Int. Cl.
*G03G 21/00* (2006.01)

(52) U.S. Cl.
CPC ..... *G03G 21/0017* (2013.01)

(58) Field of Classification Search
CPC ..... G03G 21/0017
See application file for complete search history.

(56) References Cited

U.S. PATENT DOCUMENTS

| | | | | |
|---|---|---|---|---|
| 2009/0060600 | A1* | 3/2009 | Ninomiya | G03G 15/75 399/346 |
| 2011/0217102 | A1* | 9/2011 | Ohmori | G03G 21/00 399/346 |
| 2014/0119799 | A1* | 5/2014 | Kabata | G03G 21/0017 399/350 |
| 2014/0356042 | A1* | 12/2014 | Gondoh | G03G 21/0017 399/350 |
| 2015/0014602 | A1 | 1/2015 | Matsushita et al. | |
| 2017/0003643 | A1 | 1/2017 | Aoyama et al. | |
| 2018/0017930 | A1* | 1/2018 | Aoyama | G03G 21/0017 |
| 2021/0200136 | A1 | 7/2021 | Juri et al. | |
| 2021/0230353 | A1 | 7/2021 | Aoyama et al. | |

FOREIGN PATENT DOCUMENTS

| | | |
|---|---|---|
| JP | 6-348193 | 12/1994 |
| JP | 8-220962 | 8/1996 |
| JP | 2000-147972 | 5/2000 |
| JP | 2000-305289 | 11/2000 |
| JP | 3201949 | 8/2001 |
| JP | 2003-195711 | 7/2003 |
| JP | 2007-114373 | 5/2007 |
| JP | 2015-014744 | 1/2015 |
| JP | 2017-016083 | 1/2017 |

* cited by examiner

*Primary Examiner* — Sandra Brase
(74) *Attorney, Agent, or Firm* — Grüneberg and Myers, PLLC

(57) ABSTRACT

A cleaning blade is provided. The cleaning blade includes an elastic body having a contact edge to contact a surface of a cleaning target to remove a residue on the surface. The elastic body includes a coating layer on at least a part of the contact edge. The coating layer contains fluorine-based particles and a binder comprising a fluorine-based oil.

9 Claims, 5 Drawing Sheets

CLEANING BLADE, PROCESS CARTRIDGE, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2021-002232, filed on Jan. 8, 2021, in the Japan Patent Office, the entire disclosure of which is hereby incorporated by reference herein.

BACKGROUND

Technical Field

The present disclosure relates to a cleaning blade, a process cartridge, and an image forming apparatus.

Description of the Related Art

In a conventional electrophotographic image forming apparatus, a toner image is formed on an image bearer and then transferred onto a recording medium or an intermediate transferor (also referred to as "cleaning target"). After that, residual toner particles adhered to the surface of the image bearer are removed by a cleaner.

As the cleaner, a cleaning blade is known for its simple configuration and excellent cleaning performance. The cleaning blade is usually composed of an elastic body, made of polyurethane rubber or the like, and a support. With a base end of the elastic body supported by the support, a contact part (i.e., tip edge portion) of the elastic body is pressed against the image bearer, so that residual toner particles remaining on the surface of the image bearer are dammed up and scraped off.

As the cleaning blade is brought into contact with the image bearer, friction is generated between the cleaning blade and the image bearer, and a torque that is a force necessary for rotating the image bearer is increased. This may cause the image bearer to stop rotating. Further, the contact part may be worn by rubbing between the cleaning blade and the image bearer, and the worn contact part may turn up, which allows toner particles to pass through the turned-up portion of the cleaning blade and results in defective cleaning.

SUMMARY

In accordance with some embodiments of the present invention, a cleaning blade is provided. The cleaning blade includes an elastic body having a contact edge to contact a surface of a cleaning target to remove a residue on the surface. The elastic body includes a coating layer on at least a part of the contact edge. The coating laver contains fluorine-based particles and a binder comprising a fluorine-based oil.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
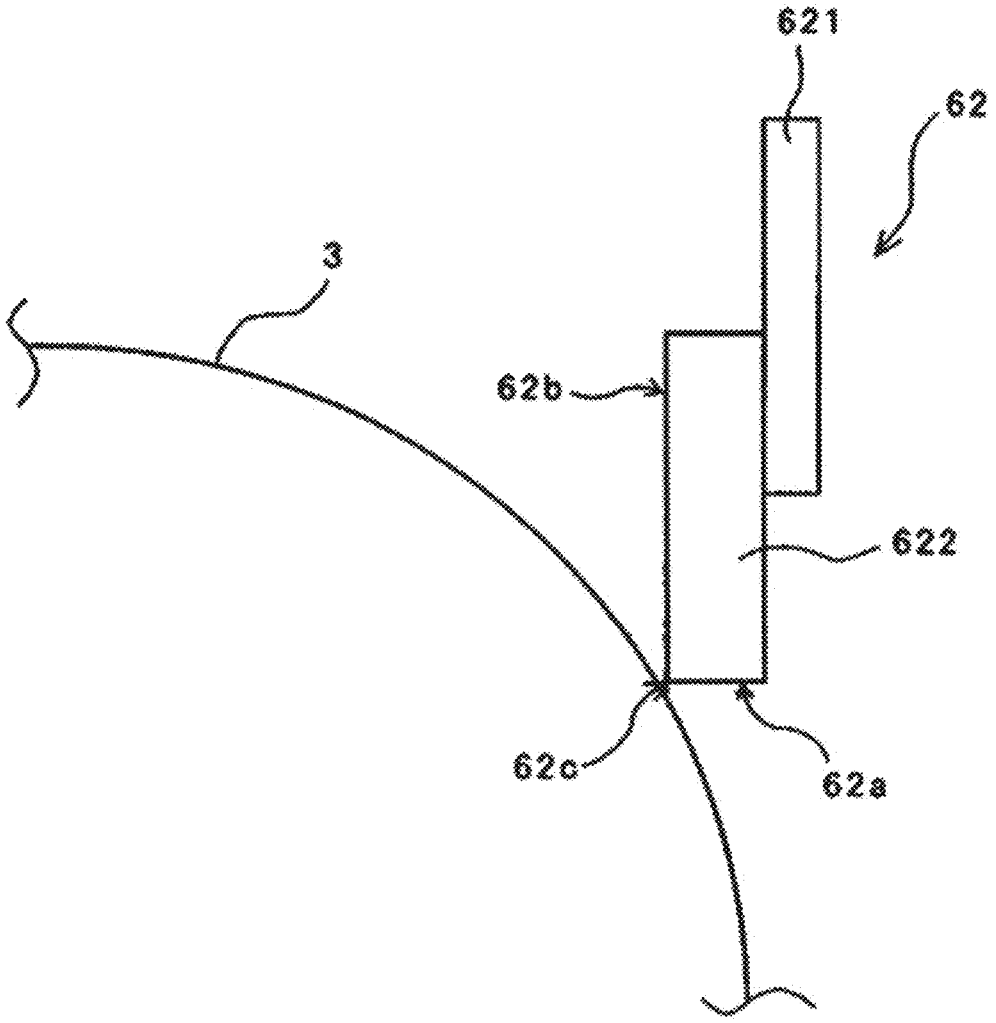
FIG. 1 is a schematic cross-sectional diagram illustrating a cleaning blade according to an embodiment of the present invention, in contact with a surface of an image bearer.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a cleaning blade having good cleaning performance is provided that suppresses an increase in torque of a cleaning target even immediately after the start of use.

Cleaning Blade

The cleaning blade according to an embodiment of the present invention includes an elastic body. The elastic body is brought into contact with a surface of a cleaning target to remove a residue adhered to the surface of the cleaning target.

The elastic body has a coating layer containing fluorine-based particles and a binder comprising at least a fluorine-based oil, and optionally contains other members as necessary.

For the purpose of increasing slidability between a cleaning blade ("blade") and an image bearer ("photoconductor") to prevent the blade from being turned up, or reducing torque of the photoconductor to prevent the photoconductor from being stopped by an increase in torque, a process called "touch-up" is usually performed in which toner or a metal soap (e.g., zinc stearate) is applied to a tip portion of the blade, at the time of unit assembly or blade replacement. The metal soap (serving as a touch-up agent) may function until the behavior of the blade gets stabilized as the toner gradually gets accumulated between the blade and the photoconductor during operation of the image forming apparatus.

Conventionally, the touch-up has been often performed manually, and the amount of application of the touch-up agent may vary depending on the operator. The conventional touch-up agent has a drawback that it liberates from the cleaning blade before the behavior of the cleaning blade gets stabilized.

For these reasons, there has been a case in which defective cleaning and an increase in torque of the image bearer occur as the cleaning blade gets turned up before the behavior of the cleaning blade gets stabilized.

Prevention of an increase in torque and improvement in the cleaning performance are in a trade-off relationship. When the contact part of the cleaning blade is smoothened to prevent an increase in torque, particles (e.g., toner) are allowed to pass through the contact part, resulting in deterioration of the cleaning performance. On the contrary, when the contact part of the cleaning blade is made uneven to improve the cleaning performance, the torque increases. It has been difficult to prevent an increase in torque and to improve the cleaning performance at the same time.

In attempting to achieve both prevention of an increase in torque and improvement in the cleaning performance, a cleaning blade has been proposed which contains fine particles in its contact part.

However, such a cleaning blade has not solved the problems of turning-up of the cleaning blade and an increase in torque of the image bearer, which occur before the behavior of the cleaning blade gets stabilized.

The inventors of the present invention have studied how to prevent fine particles from being liberated from the cleaning blade. As a result, the inventors have found that liberation of fine particles can be prevented when a dispersion of the fine particles in a binder comprising a fluorine-based oil, rather than a dispersion of the fine particles in a solvent, is applied to the cleaning blade. Further, the inventors have found that the use of a fluorine-based oil can prevent either the cleaning blade from being turned up or the torque of the image bearer from increasing, thus achieving the present invention.

Elastic Body

The elastic body includes a coating layer, and further includes other members as necessary.

The shape, material, size, structure, and the like of the elastic body are not particularly limited and can be suitably selected to suit to a particular application. The shape of the elastic body may be, for example, a flat plate shape, a strip shape, or a sheet shape. The size of the elastic body is not particularly limited and can be suitably selected depending on the size of the cleaning target.

The material of the elastic body is not particularly limited and can be suitably selected to suit to a particular application. Preferred examples thereof include polyurethane rubber and polyurethane elastomer that can easily achieve high elasticity.

The elastic body is not particularly limited and can be suitably selected to suit to a particular application. For example, the elastic body can be manufactured through the processes of: preparing a polyurethane prepolymer from a polyol compound and a polyisocyanate compound; adding a curing agent, optionally along with a curing catalyst, to the polyurethane prepolymer to cause cross-linking in a mold, followed by post-cross-linking in a furnace; forming the cross-linked product into a sheet by centrifugal molding; leaving the sheet at room temperature for aging; and cutting the sheet into a flat plate having a predetermined size.

The polyol compound is not particularly limited and can be suitably selected to suit to a particular application. Examples thereof include, but are not limited to, high-molecular-weight polyols and low-molecular-weight polyols.

Specific examples of the high-molecular-weight polyols include, but are not limited to, a polyester polyol which is a condensate of an alkylene glycol and an aliphatic diprotic acid; polyester-based polyols, such as polyester polyols of alkylene glycols with adipic acid, such as ethylene adipate ester polyol, butylene adipate ester polyol, hexylene adipate ester polyol, ethylene propylene adipate ester polyol, ethylene butylene adipate ester polyol, and ethylene neopentylene adipate ester polyol; polycaprolactone-based polyols such as polycaprolactone ester polyols obtained by ring-opening polymerization of caprolactone; and polyether-based polyols such as poly(oxytetramethylene) glycol and poly(oxypropylene) glycol. Each of these can be used alone or in combination with others.

Specific examples of the low-molecular-weight polyols include, but are not limited to, divalent alcohols such as 1,4-butanediol, ethylene glycol, neopentyl glycol, hydroquinone-bis(2-hydroxyethyl) ether, 3,3'-dichloro-4,4'-diaminodiphenylmethane, and 4,4'-diaminodiphenylmethane; and trivalent or higher polyols such as 1,1,1-trimethylolpropane, glycerin, 1,2,6-hexanetriol, 1,2,4-butanetriol, trimethylolethane, 1,1,1-tris(hydroxyethoxymethyl)propane, diglycerin, and pentaerythritol. Each of these can be used alone or in combination with others.

The polyisocyanate compound is not particularly limited and can be suitably selected to suit to a particular application. Specific examples thereof include, but are not limited to, methylene diphenyl diisocyanate (MDI), tolylene diisocyanate (TDI), xylylene diisocyanate (XDI), naphthylene 1,5-diisocyanate (NDI), tetramethylxylene diisocyanate (TMXDI), isophorone diisocyanate (IPDI), hydrogenated xylylene diisocyanate (H6XDI), dicyclohexylmethane diisocyanate (H12MDI), hexamethylene diisocyanate (HDI), dimer acid diisocyanate (DDI), norbomene diisocyanate (NBDI), and trimethvlhexamethylene diisocyanate (TMDI). Each of these can be used alone or in combination with others.

The curing catalyst is not particularly limited and can be suitably selected to suit to a particular application. Specific examples thereof include, but are not limited to, 2-methylimidazole and 1,2-dimethylimidazole.

The proportion of the curing catalyst to the resultant elastic body (e.g., polyurethane rubber, polyurethane elastomer) is not particularly limited and can be suitably selected to suit to a particular application, but is preferably from 0.01% to 0.5% by mass, and more preferably from 0.05% to 0.3% by mass.

The JIS-A hardness of the elastic body is not particularly limited and can be suitably selected to suit to a particular application, but is preferably from 65 to 83 degrees. When the JIS-A hardness is within this preferred range, the following undesired phenomena can be prevented.

- The linear pressure of the blade hardly achieves a desired level, so that the area of the contact part with the image bearer increases and defective cleaning occurs.
- The blade becomes excessively hard, and chipping is likely to occur.

The elastic body is not particularly limited and can be suitably selected to suit to a particular application, but a laminate of two or more types of rubbers having different JIS-A hardness values, integrated by molding, is preferred for achieving both wear resistance and conformability.

The JIS-A hardness of the elastic body can be measured using, for example, a micro rubber durometer MD-1, product of Kobunshi Keiki Co., Ltd.

The rebound resilience according to the Japanese Industrial Standards (JIS) K6255 of the elastic body is not particularly limited and can be suitably selected to suit to a particular application, but is preferably from 36% to 73%, more preferably from 52% to 73%, at 23° C. When the rebound resilience is within this preferred range, the following undesired phenomena can be prevented.

The entire elastic body loses its flexibility and becomes unable to follow runout or roughness of the image bearer, resulting in defective cleaning.

The repulsion becomes too strong and blade squeak occurs.

The rebound resilience of the elastic body can be measured according to JIS K6255 at 23° C. using, for example, a resilience tester No. 221, product of Toyo Seiki Seisakusho, Ltd.

The average thickness of the elastic body is not particularly limited and can be suitably selected to suit to a particular application, but is preferably from 1.0 to 3.0 mm.

Coating Layer

The coating layer (also be referred to as "surface coating layer") is formed on at least a part of a contact edge of the elastic body that is brought into contact with a cleaning target.

Preferably, the coating layer is formed on the entire of the contact edge. Alternatively, the coating layer may be formed on the entire of the elastic body.

The coating layer contains fluorine-based particles and a binder comprising at least a fluorine-based oil, and further contains other components as necessary.

The proportion of the fluorine-based particles in the coating layer is preferably from 4% to 8% by mass, and more preferably from 4.5% to 5.5% by mass.

The proportion of the binder in the coating layer is preferably from 1.5% to 3% by mass, and more preferably from 1.8% to 2.2% by mass.

Fluorine-Based Particles

Specific examples of the fluorine-based particles (including fluorine-based resin fine particles and fluorine-based resin micropowder) include, but are not limited to, polytetrafluoroethylene (PTFE), fluorinated ethylene-propylene copolymer (FEP), perfluoroalkoxy polymer (PFA), chlorotrifluoroethylene copolymer (CTFE), tetrafluoroethylene-chlorotrifluoroethylene copolymer (TFE/CTFE), ethylene-chlorotrifluoroethylene copolymer (ECTFE), and polychlorotrifluoroethylene (PCTFE).

Among these, PTFE is preferred for improving various effects of embodiments of the present disclosure. Such fine particles or micropowder of PTFE can be obtained by emulsion polymerization.

The fluorine-based particles made of polytetrafluoroethylene (PTFE) are available either by synthesis or from commercial products. Specific examples of the commercial products include, but are not limited to, DYNEON TF MICROPOWDER TF-9201Z and DYNEON TF MICROPOWDER TF-9207Z (products of 3M Company). NanoFLON 119N and FLUORO E (products of Shamrock Technologies), TLP10F-1 (product of DuPont-Mitsui Fluorochemicals, Co., Ltd.), KTL-500F (product of KITAMURA LIMITED), and ALGOFLON L203F (product of Solvay S.A.).

The shapes of the fluorine-based particles are not particularly limited and can be suitably selected to suit to a particular application, but the fluorine-based particles are preferably spherical.

A volume average particle diameter of the fluorine-based particles is not particularly limited and can be suitably selected to suit to a particular application. In particular, a volume average particle diameter (e.g., 50% volume diameter, median diameter) measured by means of laser diffraction/scattering, dynamic light scattering, imaging method, etc., is preferably 1 μm or less, more preferably 0.5 μm or less, and still more preferably 0.3 μm or less.

When the volume average particle diameter is 1 μm or less, the fluorine-based particles are prevented from being precipitated and unstably dispersed in a solvent. When the average particle diameter is 0.5 μm or less, the fluorine-based particles can be more stably dispersed in the solvent.

The volume average particle diameter of the fluorine-based particles is preferably 0.1 μm or more.

The volume average particle diameter of the fluorine-based particles may be measured, for example, by collecting the fluorine-based particles from the cleaning blade and subjected to a laser diffraction/scattering measurement using an instrument MICROTRAC (product of Nikkiso Co., Ltd.), or by directly observing and measuring the fluorine-based particles on the cleaning blade using a scanning electron microscope (SEM).

The volume average particle diameter of the fluorine-based particles present in the coating layer is almost the same as that of the fluorine-based particles before being added to the coating layer in the manufacturing process of the cleaning blade.

In the present disclosure, the fluorine-based particles may be used in combination with other particles as necessary. Examples thereof include inorganic compound particles and resin particles. Specific examples of the inorganic compound particles include, but are not limited to, silica, alumina, and zirconia. Specific examples of the resin particles include, but are not limited to, acrylic resins, styrene resins, and vinyl resins. Each of these can be used alone or in combination with others.

Binder

The binder contains at least a fluorine-based oil that is capable of uniformly and stably dispersing the fluorine-based particles. The fluorine-based oil improves not only a binder function but also a sliding function. Specific examples of the fluorine-based oil include, but are not limited to, those having a tetrafluoroethylene (TFE) oligomer or a perfluoroether as the main backbone.

The fluorine-based oil having a perfluoroether as the main backbone is not particularly limited and may be suitably selected as long as it has slidability and does not inhibit dispersion of the fluorine-based particles. Considering kinematic viscosity, fluorine-based oils having a weight average molecular weight of about 2,000 to 3,500 are preferred. Specific examples of the fluorine-based oil having a perfluoroether backbone include, but are not limited to, PT-02 (weight average molecular weight: 2,000). PT-82 (weight average molecular weight: 2,800), and PT-53 (weight average molecular weight: 3,500), all products of NICCA CHEMICAL CO., LTD. The weight average molecular weight can be measured by gel permeation chromatography (GPC) in terms of polystyrene in accordance with conventional procedures.

The binder may consist of a fluorine-based oil alone, or may be a mixture of a fluorine-based oil and a fluorine-based resin. Preferred examples of the fluorine-based resin include a terpolymer of vinylidene fluoride (VdF), hexafluoropropylene (HFP), and tetrafluoroethylene (TFE) ("VdF-HFP-TFE terpolymer), for more improving various effects of embodiments of the present invention. Preferably, the proportions of VdF, HFP, and TFE in the VdF-HFP-TFE terpolymer are 30% to 85% by mol, 10% to 35% by mol, and 5% to 35% by mol, respectively, in view of flexibility and solubility in solvents as the binder.

In the case in which the binder is a mixture of a fluorine-based oil and a fluorine-based resin, the proportion of the fluorine-based resin to the entire binder is preferably from 90% to 99%/o by mass, and more preferably from 95% to 98% by mass.

Solvent

The binder of the present disclosure may further contain a solvent.

The solvent is not particularly limited and can be suitably selected to suit to a particular application. Examples thereof include fluorine-containing organic solvents.

Specific examples of the fluorine-containing organic solvents include, but are not limited to, hydrofluoroether (HFE), perfluorocarbon (PFC), and perfluoroether (PFE). Each of these may be used alone or in combination with others.

The proportion of the solvent to the entire binder is preferably from 90% to 99% by mass, and more preferably from 97% to 98% by mass.

Method for Producing Coating Layer

A method for producing the coating layer is not particularly limited and can be suitably selected to suit to a particular application. For example, the coating layer may be produced through the processes of mixing a fluorine-containing organic solvent and a binder, adding fluorine-based particles to the resultant mixture (i.e., binder dispersion), mixing them, and applying the mixture to the elastic body.

Preferably, an average particle diameter of the fluorine-based particles in the binder dispersion measured by a dynamic light scattering method (e.g., an average particle diameter measured by a cumulant analysis method in scattering intensity distribution) is 1 μm or less.

Generally, fine particles having a volume average particle diameter of 1 μm or less usually agglomerate into secondary particles having a particle diameter of 1 μm or more.

In the present disclosure, the fluorine-based particles are dispersed in the binder in a manner that they have a particle diameter of 1 μm or less, so that the dispersion is maintained stable even when stored at a low viscosity for a long period of time. Specific methods of dispersing include, but are not limited to, methods using a disperser such as ultrasonic disperser, three roll mill, ball mill, bead mill, and jet mill.

The volume average particle diameter of the particles in the binder dispersion is preferably 1 μm or less, more preferably 0.5 μm or less, and still more preferably 0.3 μm or less, for obtaining a uniform dispersion.

A method for forming the coating layer is not particularly limited and can be suitably selected to suit to a particular application. For example, the coating layer may be formed by dipping an elastic body in a dispersion of fluorine-based particles in a binder. In addition to dipping, spray coating or dispenser coating may also be employed.

Cleaning Target

The material, shape, structure, size, and the like of the cleaning target are not particularly limited and can be suitably selected to suit to a particular application. The shape of the cleaning target may be, for example, a drum shape, a belt shape, a flat plate shape, or a sheet shape. The size of the cleaning target is not particularly limited and can be suitably selected to suit to a particular application, but the cleaning target is preferably in a size that is generally used.

The material of the cleaning target is not particularly limited and can be suitably selected to suit to a particular application. Examples thereof include, but are not limited to, metals, plastics, and ceramics.

The cleaning target is not particularly limited and can be suitably selected to suit to a particular application. In a case in which the cleaning blade is mounted on an image forming apparatus, the cleaning target may be an image bearer.

Residue

The residue is not particularly limited as long as it is adhered to the surface of the cleaning target and is to be removed by the cleaning blade. Examples of the residue include, but are not limited to, toner, lubricant, inorganic particles, organic particles, dust, and mixtures thereof.

Other Members

The other members are not particularly limited and can be suitably selected to suit to a particular application. Examples thereof include, but are not limited to, a support.

The shape, size, material, and the like of the support are not particularly limited and can be suitably selected to suit to a particular application. The shape of the support may be, for example, a flat plate shape, a strip shape, or a sheet shape. The size of the support is not particularly limited and can be suitably selected according to the size of the cleaning target.

Examples of the material of the support include, but are not limited to, metals, plastics, and ceramics. Among these, metal plates are preferred for their strength, and steel plates (e.g., stainless steel plates), aluminum plates, and phosphor bronze plates are particularly preferred.

The cleaning blade according to an embodiment of the present invention is described below with reference to the drawings.

In each drawing, the same reference numerals are given to the same components, and redundant explanation may be omitted. The number, position, shape, and the like of the constituent members are not limited to those in the embodiments described below, and can be suitably set to suit to a particular application.

Figure 2:
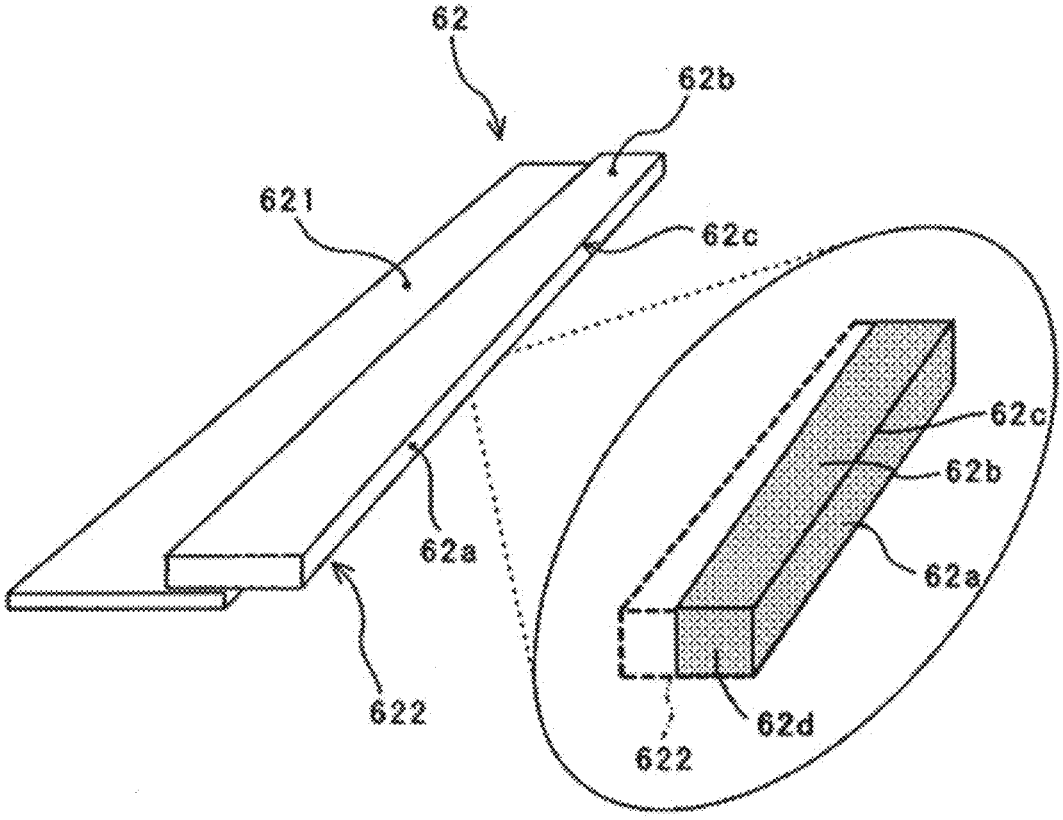
FIG. 2 is a perspective view of the cleaning blade illustrated in FIG. 1.

FIG. 1 is a schematic cross-sectional diagram illustrating a cleaning blade 62 of the present disclosure in contact with the surface of an image bearer 3. FIG. 2 is a perspective view of the cleaning blade 62 in FIG. 1 including an enlarged view of the vicinity of its contact part.

As illustrated in FIG. 1, the cleaning blade 62 includes a flat-plate-shaped support 621 made of a rigid material (e.g., metal, hard plastic) and a flat-plate-shaped elastic body 622. The elastic body 622 is fixed to one end side of the support 621 with an adhesive or the like. The other end side of the support 621 is supported by a casing of a cleaning device in a cantilever manner. In FIG. 1, a blade tip surface 62*a*, a blade lower surface 62*b*, and a contact part 62*c* (also referred to as "tip edge portion" or "edge portion") are also illustrated.

Referring to FIG. 2, the cleaning blade 62 includes the support 621 and the elastic body 622 in a flat plate shape. One end of the elastic body 622 is coupled to the support 621, and the other end is a free end with a certain length. The cleaning blade 62 is disposed in a manner that the contact part 62*c*, which is on the free end side of the elastic body 622, contacts the surface of the image bearer along the longitudinal direction.

The elastic body 622 has a coating layer 62*d* on at least a part of the contact part 62*c*.

Image Forming Apparatus and Image Forming Method

An image forming apparatus of the present disclosure includes: an image bearer; a charger to charge a surface of the image bearer; an irradiator to irradiate the charged surface of the image bearer to form an electrostatic latent image; a developing device to develop the electrostatic latent image into a toner image; a transfer device to transfer the toner image onto a recording medium; a fixing device to fix the transferred toner image on the recording medium; and a cleaning device to contact the surface of the image bearer to remove a residue on the surface of the image bearer. The image forming apparatus may further include other devices as necessary. The charger and the irradiator may be collectively referred to as an "electrostatic latent image forming device".

An image forming method of the present disclosure includes a charging process, an irradiation process, a developing process, a transfer process, a fixing process, and a cleaning process, and further includes other processes as necessary. The charging and irradiation processes may be collectively referred to as an "electrostatic latent image forming process".

The image forming method of the present disclosure is preferably performed by the image forming apparatus of the present disclosure. The charging process may be performed by the charger, the irradiation process may be performed by the irradiator, the developing process may be performed by the developing device, the transfer process may be performed by the transfer device, the fixing process may be performed by the fixing device, the cleaning process may be performed by the cleaning device, and the other processes may be performed by the other devices.

Image Bearer

The material, shape, structure, size, and the like of the image bearer (also referred to as "electrophotographic photoconductor" or "photoconductor") are not particularly limited and can be suitably selected from known ones. The shape of the image bearer may be, for example, a drum shape or a belt shape. The material of the image bearer may comprise, for example, inorganic photoconductors such as amorphous silicon and selenium, and organic photoconductors (OPC) such as polysilane and phthalopolymethine.

Charger and Charging Process

The charging process is a process of charging the surface of the image bearer, and is performed by the charger.

The charger is not particularly limited and can be suitably selected to suit to a particular application as long as it is capable of charging the surface of the image bearer. Specific examples thereof include, but are not limited to, contact chargers equipped with a conductive or semiconductive roller, brush, film, or rubber blade and non-contact chargers employing corona discharge such as corotron and scorotron.

The shape of the charger is determined in accordance with the specification or configuration of the image forming apparatus, and may be in the form of a roller, a magnetic brush, or a fur brush. The magnetic brush may be composed of various ferrite particles (e.g., Zn—Cu ferrite) serving as the charger, a non-magnetic conductive sleeve for supporting the ferrite particles, and a magnet roll contained inside the conductive sleeve. The fur brush may be made of a fur having been subjected to a conductive treatment with carbon, copper sulfide, a metal, or a metal oxide. Such a fur is wound around or attached to a cored bar having been subjected to a conductive treatment with a metal or the like to be formed into the charger.

The charger is not limited to the contact charger. However, the contact charger is preferred because the amount of by-product ozone is small.

Preferably, the charger is disposed in or out of contact with the image bearer and capable of charging the surface of the image bearer by applying direct-current and alternating-current voltages in superimposition thereto.

Preferably, the charger is a charging roller disposed close to but out of contact with the image bearer via a gap tape and capable of charging the surface of the image bearer by applying direct-current and alternating-current voltages in superimposition thereto.

Irradiator and Irradiation Process

The irradiation process is a process of irradiating the charged surface of the image bearer with light, and is performed by the irradiator. The irradiation process may be performed by irradiating the surface of the image bearer with light containing image information by the irradiator.

The optical system in the irradiator is roughly divided into an analog optical system and a digital optical system. The analog optical system directly projects an original document onto the surface of the image bearer. The digital optical system receives image information as an electric signal, converts the electric signal into an optical signal, and irradiates the image bearer with the optical signal to form an image.

The irradiator is not particularly limited and can be suitably selected to suit to a particular application as long as it is capable of irradiating the charged image bearer with light to form an electrostatic latent image. Specific examples thereof include, but are not limited to, various irradiators of radiation optical system type, rod lens array type, laser optical type, liquid crystal shutter optical type, and light emitting diode (LED) optical type.

The irradiation can also be conducted by irradiating the back surface of the image bearer with light containing image information.

Developing Process and Developing Device

The developing process is a process of developing the electrostatic latent image into a toner image, and is performed by the developing device.

The developing device is not particularly limited and can be suitably selected to suit to a particular application as long as it is capable of developing the electrostatic latent image into a toner image. Preferred examples thereof include those containing toner and capable of applying the toner to the electrostatic latent image in a contact or non-contact manner.

The developing device may be of either a dry developing type or a wet developing type. The developing device may be either a monochrome developing device or a multicolor developing device. Preferably, the developing device includes a stirrer that frictionally stirs and charges the toner and a rotatable magnet roller.

In the developing device, toner particles and carrier particles are mixed and stirred. The toner particles are charged by friction and retained on the surface of the rotating magnet roller, thus forming magnetic brush. The magnet roller is disposed proximity to the image bearer, so that a part of the toner particles composing the magnetic brush formed on the surface of the magnet roller are moved to the surface of the image bearer by an electric attractive force of the electrostatic latent image. As a result, the electrostatic latent image is developed with the toner to form the toner image on the surface of the image bearer.

The toner contained in the developing device may be a developer containing the toner, and the developer may be either a one-component developer or a two-component developer.

The toner may be either a magnetic toner used as a one-component developer without using a carrier, or a non-magnetic toner.

Transfer Process and Transfer Device

The transfer process is a process of transferring the toner image onto a recording medium, and is performed by the transfer device.

The transfer process preferably includes: a primary transfer process of transferring the toner image onto a surface of an intermediate transferor to form a composite transfer image; and a secondary transfer process of transferring the composite transfer image onto a recording medium.

The transfer device is not particularly limited and can be suitably selected to suit to a particular application as long as it is capable of transferring the toner image onto a recording medium. Preferably, the transfer device includes: a primary transfer device that transfers the toner image onto a surface of an intermediate transferor to form a composite transfer image; and a secondary transfer device that transfers the composite transfer image onto a recording medium.

The primary transfer device and the secondary transfer device each preferably include a transferrer that separates the toner image formed on the image bearer toward the recording medium by charging.

The transferrer is not particularly limited and can be suitably selected to suit to a particular application. Specific examples thereof include, but are not limited to, a corona transferrer utilizing corona discharge, a transfer belt, a transfer roller, a pressure transfer roller, and an adhesive transferrer. The number of the transferrers is at least one, and may be two or more.

The recording medium is not particularly limited and can be suitably selected to suit to a particular application as long as an unfixed toner image can be transferred thereon. Specific examples thereof include, but are not limited to, plain paper and polyethylene terephthalate (PET) sheets for overhead projectors (OHP).

Fixing Process and Fixing Device

The fixing process is a process of fixing the transferred toner image on the recording medium, and is performed by the fixing device. In a case in which toners of two or more colors are used, the toner of each color may be fixed each time the toner is transferred onto the recording medium, or the toners of all colors may be fixed at once after being transferred and stacked on the recording medium.

The fixing device is not particularly limited and can be suitably selected to suit to a particular application as long as it is capable of fixing the transferred toner image on the recording medium. The fixing device may employ a thermal fixing method using a known heat-pressure assembly.

Specific examples of the heat-pressure assembly include, but are not limited to, a combination of a heat roller and a pressure roller, and a combination of a heat roller, a pressure roller, and an endless belt. The heating temperature is not particularly limited and can be suitably selected to suit to a particular application, but is preferably from 80° C. to 200° C. The fixing device may be used together with an optical fixer as necessary.

Cleaning Process and Cleaner

The cleaning process is a process of removing the toner remaining on the surface of the image bearer, and is performed by the cleaning device.

The cleaning device includes the cleaning blade according to an embodiment of the present invention.

The linear pressure applied to the image bearer by the elastic body is not particularly limited and can be suitably selected to suit to a particular application, but is preferably from 10 to 100 N/m, and more preferably from 10 to 50 N/m. When the linear pressure is from 10 to 100 N/m, defective cleaning in which the toner slips through between the contact part and the cleaning target is less likely to occur, and the elastic body is suppressed from being turned up.

The linear pressure can be measured using, for example, a measuring apparatus incorporating a small compression load cell available from KYOWA ELECTRONIC INSTRUMENTS CO., LTD.

An angle ("cleaning angle") formed between a tangent line of the cleaning target at a position that comes into contact with the contact part of the elastic body and the tip surface of the free end of the elastic body is not particularly limited and can be suitably selected to suit to a particular application, but is preferably from 650 to 85°.

When the cleaning angle is from 65° to 85°, the elastic body can be suppressed from being turned up and the occurrence of defective cleaning can be reduced.

Other Processes and Other Devices

The other processes may include, for example, a neutralization process, a recycle process, and a control process.

The other devices may include, for example, a neutralizer, a recycler, and a controller.

Neutralization Process and Neutralizer

The neutralization process is a process of applying a neutralization bias voltage to the image bearer to remove charge, and is performed by the neutralizer.

The neutralizer is not particularly limited and can be suitably selected to suit to a particular application as long as it is capable of applying a neutralization bias voltage to the image bearer. Specific examples of the neutralizer include, but are not limited to, a neutralization lamp.

Recycle Process and Recycler

The recycle process is a process of recycling the toner removed in the cleaning process for the developing device, and is performed by the recycler.

The recycler is not particularly limited and can be suitably selected to suit to a particular application. Specific examples thereof include, but are not limited to, a conveyor.

Control Process and Controller

The control process is a process of controlling each of the processes, and is performed by the controller.

The controller is not particularly limited and can be suitably selected to suit to a particular application as long as it is capable of controlling each of the devices. Specific examples thereof include, but are not limited to, a sequencer and a computer.

An image forming apparatus according to an embodiment of the present invention is described below with reference to the drawings.

Figure 3:
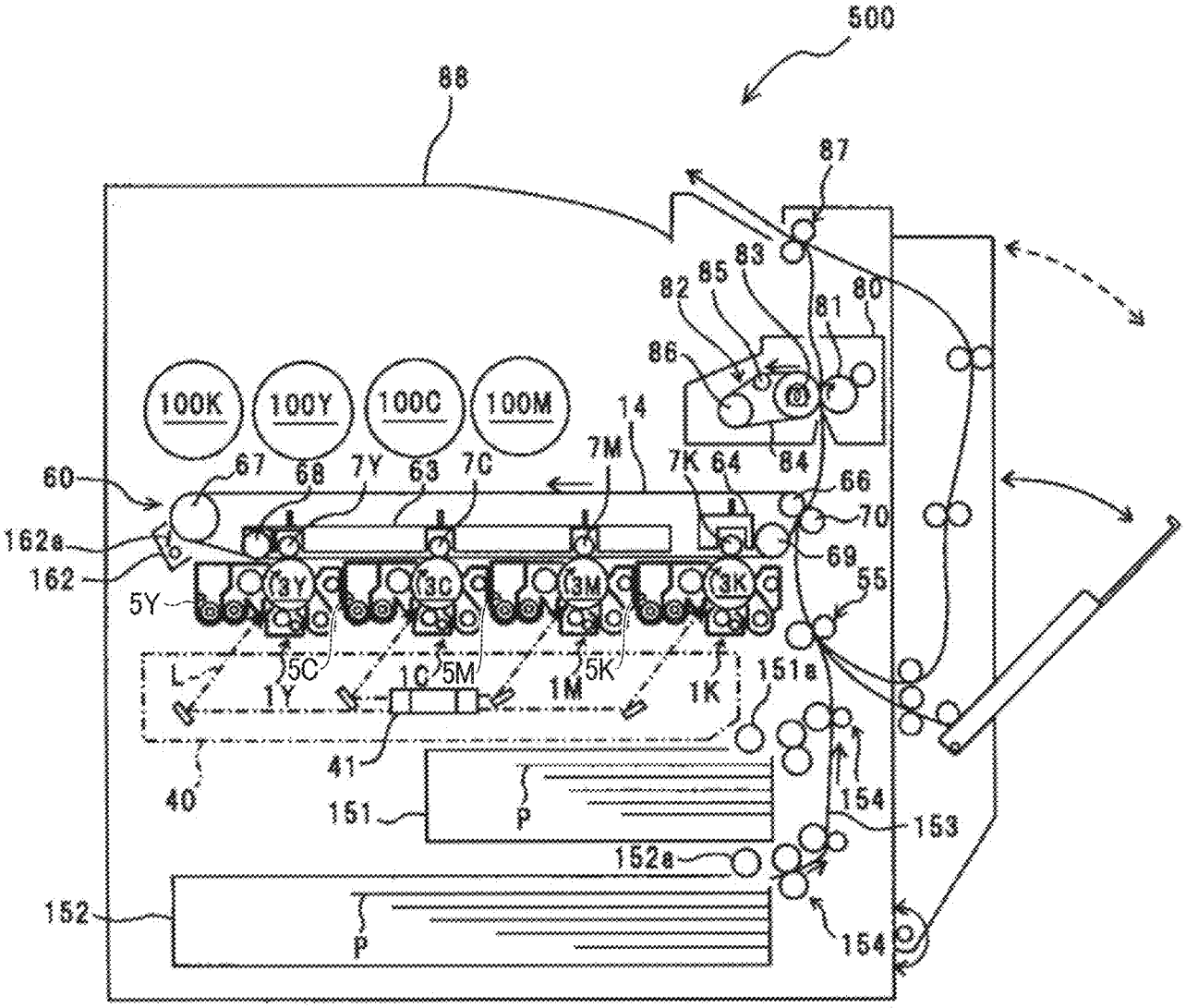
FIG. 3 is a schematic cross-sectional diagram illustrating an image forming apparatus according to an embodiment of the present invention.

FIG. 3 is a schematic diagram illustrating an image forming apparatus 500 according to an embodiment of the present invention. The image forming apparatus 500 includes four image forming units 1Y, 1C, 1M, and 1K for forming yellow, cyan, magenta, and black ("Y, C, M, and K") images, respectively. The image forming units 1Y, 1C, 1M, and 1K have the same configuration except for accommodating different color toners, i.e., yellow, cyan, magenta, and black toners, respectively, as image forming materials.

Above the four image forming units 1Y, 1C, 1M, and 1K (collectively "image forming units 1"), a transfer unit 60 is disposed. The transfer unit 60 includes an intermediate transfer belt 14 as an intermediate transferor. The image forming units 1Y, 1C, 1M, and 1K include respective photoconductors 3Y, 3C, 3M, and 3K on which toner images with respective colors are to be formed. The toner images are superimposed on one another on a surface of the intermediate transfer belt 14.

Below the four image forming units 1, an optical writing unit 40 is disposed. The optical writing unit 40, serving as a latent image forming device, emits laser light L based on image information to the photoconductors 3Y, 3C, 3M, and 3K in the respective image forming units 1Y, 1C, 1M, and 1K. Thus, electrostatic latent images for yellow, cyan, magenta, and black images are formed on the respective photoconductors 3Y, 3C, 3M, and 3K. In the optical writing unit 40, the laser light L is emitted from a light source, deflected by a polygon mirror 41 that is rotary-driven by a motor, and directed to the photoconductors 3Y, 3C, 3M, and 3K through multiple optical lenses and mirrors. Alternatively, the optical writing unit 40 can be replaced with another unit in which a light emitting diode (LED) array performs optical scanning.

Below the optical writing unit 40, a first sheet feeding cassette 151 and a second sheet feeding cassette 152 are disposed so as to overlap each other in the vertical direction. In each sheet feeding cassette, multiple recording media P are stacked on top of another. The top one of the recording media P in each sheet feeding cassette is in contact with a first sheet feeding roller 151*a* or a second sheet feeding roller 152*a*. As the first sheet feeding roller 151*a* is rotary-driven counterclockwise in FIG. 3 by a driver, the top one of the recording media P in the first sheet feeding cassette 151 is fed to a sheet feeding path 153 that is vertically extended on a right side of the sheet feeding cassettes in FIG. 3. As the second sheet feeding roller 152*a* is rotary-driven counterclockwise in FIG. 3 by a driver, the top one of the recording media P in the second sheet feeding cassette 152 is fed to the sheet feeding path 153.

On the sheet feeding path 153, multiple conveyance roller pairs 154 are disposed. The recording medium P fed to the sheet feeding path 153 is conveyed upward in FIG. 3 inside the sheet feeding path 153 while being nipped by the rollers of the conveyance roller pairs 154.

On a downstream end of the sheet feeding path 153 relative to the direction of conveyance of the recording medium P, a registration roller pair 55 is disposed. The rollers of the registration roller pair 55 nip the recording medium P fed by the conveyance roller pairs 154 and stop rotating immediately thereafter. The registration roller pair 55 then timely feeds the recording medium P to a secondary transfer nip (to be described later).

Figure 4:
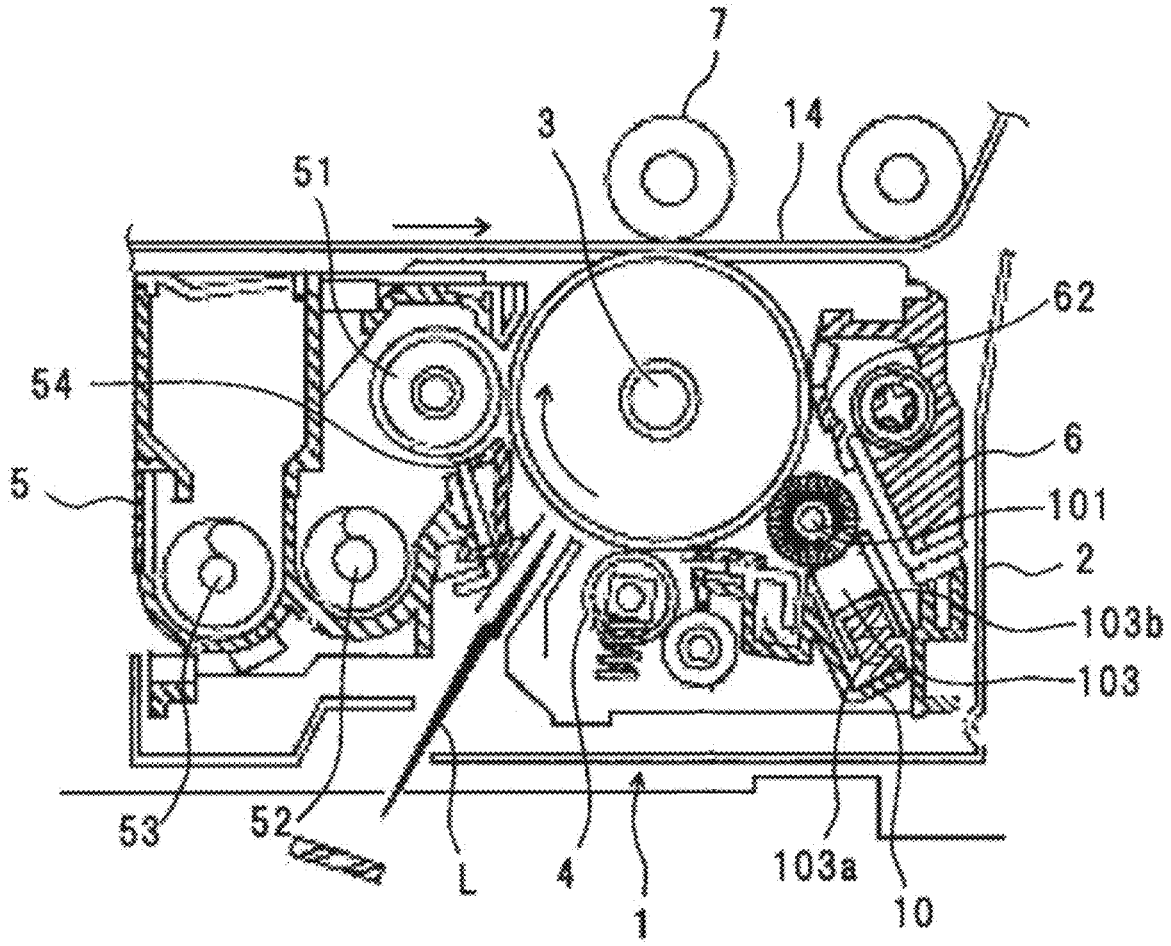
FIG. 4 is a schematic cross-sectional diagram illustrating an image forming unit in the image forming apparatus illustrated in FIG. 3.

FIG. 4 is a schematic diagram illustrating one of the four image forming units 1.

As illustrated in FIG. 4, each of the image forming units 1 includes a drum-shaped photoconductor 3 serving as an image bearer. The photoconductor 3 is in the shape of a drum but may also be in the shape of a sheet or an endless belt.

Around the photoconductor 3, a charging roller 4, a developing device 5, a primary transfer roller 7, a cleaning device 6, a lubricant applicator 10, and a neutralization lamp are disposed. The charging roller 4 is a charging member of the charger. The developing device 5 develops a latent image formed on a surface of the photoconductor 3 into a toner image. The primary transfer roller 7 is a primary transfer member of the primary transfer device that transfers the toner image from the surface of the photoconductor 3 onto the intermediate transfer belt 14. The cleaning device 6 removes residual toner particles remaining on the photoconductor 3 after the toner image has been transferred therefrom onto the intermediate transfer belt 14. The lubricant applicator 10 applies a lubricant to the surface of the photoconductor 3 having been cleaned by the cleaning device 6. The neutralization lamp is the neutralizer that neutralizes the surface potential of the photoconductor 3 having been cleaned.

The charging roller 4 is disposed at a predetermined distance from the photoconductor 3 without contacting the photoconductor 3. The charging roller 4 charges the photoconductor 3 to a predetermined potential with a predetermined polarity. After the charging roller 4 has uniformly charged the surface of the photoconductor 3, the optical writing unit 40 emits the laser light L to the charged surface of the photoconductor 3 based on image information to form an electrostatic latent image.

The developing device 5 includes a developing roller 51 serving as a developer bearer. The developing roller 51 is to be applied with a developing bias from a power source. Within the casing of the developing device 5, a supply screw 52 and a stirring screw 53 are provided for stirring the developer contained in the casing while conveying the developer in opposite directions. Also, a doctor 54 for regulating the developer carried on the developing roller 51 is disposed within the casing. As the developer is stirred and conveyed by the supply screw 52 and the stirring screw 53, toner particles in the developer are charged to have a predetermined polarity. The developer is then carried on the surface of the developing roller 51 and regulated by the doctor 54. Toner particles in the developer adhere to a latent image formed on the photoconductor 3 at a developing region where the developing roller 51 faces the photoconductor 3.

The cleaning device 6 includes a fur brush 101 and the cleaning blade 62. The cleaning blade 62 is in contact with the photoconductor 3 so as to face in the direction of movement of the surface of the photoconductor 3. Details of the cleaning blade 62 are as described above.

The lubricant applicator 10 includes a solid lubricant 103 and a lubricant pressing spring 103*a*. The fur brush 101 serves as an application brush that applies the solid lubricant 103 to the photoconductor 3. The solid lubricant 103 is held by a bracket 103*b* and pressed toward the fur brush 101 by the lubricant pressing spring 103*a*. As the fur brush 101 rotates so as to trail the rotation of the photoconductor 3, the solid lubricant 103 is scraped by the fur brush 101 and the scraped-off lubricant is applied to the photoconductor 3. As the lubricant is applied to the photoconductor 3, the coefficient of friction of the surface of the photoconductor 3 is maintained at 0.2 or less during non-image forming periods.

The charger employs a non-contact proximity arrangement system in which the charging roller 4 is disposed in proximity to the photoconductor 3 without contacting the photoconductor 3. Alternatively, any known charger such as a corotron, a scorotron, and a solid state charger can also be used as the charger. Among these charging systems, contact charging systems and non-contact proximity arrangement systems are preferred, since they have advantages in terms of high charging efficiency, less generation of ozone, and compact size.

Examples of the light source of the optical writing unit 40 that emits the laser light L and the light source of the neutralization lamp include all luminous matters such as fluorescent lamp, tungsten lamp, halogen lamp, mercury lamp, sodium-vapor lamp, light-emitting diode (LED), laser diode (LD), and electroluminescence (EL).

For the purpose of emitting only light having a desired wavelength, any type of filter can be used, such as sharp cut filter, band pass filter, near infrared cut filter, dichroic filter, interference filter, and color-temperature conversion filter.

Among these light sources, light-emitting diode and semiconductor laser are preferred since they can emit long-wavelength light (600-800 nm) with high energy.

Referring to FIG. 3, the transfer unit 60 serving as the transfer device further includes, in addition to the intermediate transfer belt 14, a belt cleaning unit 162, a first bracket 63, and a second bracket 64. The transfer unit 60 further includes four primary transfer rollers 7Y, 7C, 7M, and 7K, a secondary transfer backup roller 66, a driving roller 67, an auxiliary roller 68, and a tension roller 69. The intermediate transfer belt 14 is stretched taut with these eight rollers and is rotary-driven by the driving roller 67 to endlessly move counterclockwise in FIG. 3. The four primary transfer rollers 7Y, 7C, 7M, and 7K and the respective photoconductors 3Y, 3C, 3M, and 3K are sandwiching the intermediate transfer belt 14 that is endlessly moved, forming respective primary transfer nips therebetween. The back surface (i.e., inner circumferential surface of the loop) of the intermediate transfer belt 14 is then applied with a transfer bias having the opposite polarity to the toner (e.g., positive polarity). As the intermediate transfer belt 14 endlessly moves while sequentially passing the primary transfer nips of yellow, cyan, magenta, and black, the toner images of yellow, cyan, magenta, and black formed on the respective photoconductors 3Y, 3C. 3M, and 3K are superimposed on one another on the outer circumferential surface of the intermediate transfer belt 14. Thus, a composite toner image in which four color toner images are superimposed on one another is formed on the intermediate transfer belt 14.

The secondary transfer backup roller 66 and a secondary transfer roller 70, disposed outside the loop of the intermediate transfer belt 14, are sandwiching the intermediate transfer belt 14 to form a secondary transfer nip therebetween. The above-described registration roller pair 55 feeds the recording medium P to the secondary transfer nip in synchronization with an entry of the composite toner image on the intermediate transfer belt 14 into the secondary transfer nip. The composite toner image on the intermediate transfer belt 14 is secondarily transferred onto the recording medium P in the secondary transfer nip by the actions of a secondary transfer electric field and the nip pressure. The secondary transfer electric field is formed between the secondary transfer roller 70 to which a secondary transfer bias is applied and the secondary transfer backup roller 66. The composite toner image is combined with the white color of the recording medium P to become a full-color toner image.

On the intermediate transfer belt 14 having passed through the secondary transfer nip, residual toner particles that have not been transferred onto the recording medium P are remaining. These residual toner particles are removed by the belt cleaning unit 162. The belt cleaning unit 162 includes a belt cleaning blade 162*a* in contact with the outer circumferential surface of the intermediate transfer belt 14. The belt cleaning blade 162*a* scrapes off the residual toner particles from the intermediate transfer belt 14.

The first bracket 63 of the transfer unit 60 is swingable about the rotation axis of the auxiliary roller 68 at a predetermined angle in accordance with on/off driving operation of a solenoid. When the image forming apparatus 500 is to form a black-and-white image, the first bracket 63 is slightly rotated counterclockwise in FIG. 3 by driving the solenoid. This rotation of the first bracket 63 makes the primary transfer rollers 7Y, 7C, and 7M revolve counterclockwise in FIG. 3 about the rotation axis of the auxiliary roller 68 to bring the intermediate transfer belt 14 away from the photoconductors 3Y, 3C, and 3M. Thus, among the four image forming units 1Y, 1C, 1M, and 1K, only the image forming unit 1K for black image is brought into operation to form a black-and-white image. Since unnecessary driving of the image forming units 1Y, 1C, and 1M is avoid during formation of the black-and-white image, undesired deterioration of compositional members of the image forming units 1Y, 1C, and 1M can be prevented.

Above the secondary transfer nip in FIG. 3, a fixing unit 80 is disposed. The fixing unit 80 includes a pressure heating roller 81 and a fixing belt unit 82. The pressure heating roller 81 contains a heat source, such as a halogen lamp, inside. The fixing belt unit 82 includes a fixing belt 84 serving as a fixing member, a heating roller 83 containing a heat source (e.g., halogen lamp) inside, a tension roller 85, a driving roller 86, and a temperature sensor. The fixing belt 84 in an endless-belt form is stretched taut with the heating roller 83, the tension roller 85, and the driving roller 86, and is endlessly moved counterclockwise in FIG. 3. The fixing belt 84 is heated from its back surface side by the heating roller 83 while endlessly moving. At a position where the fixing belt 84 is wound around the heating roller 83, the pressure heating roller 81 is contacting the outer circumferential surface of the fixing belt 84. The pressure heating roller 81 is driven to rotate clockwise in FIG. 3. Thus, the pressure heating roller 81 and the fixing belt 84 form a fixing nip therebetween.

The temperature sensor is disposed outside the loop of the fixing belt 84 facing the outer circumferential surface of the fixing belt 84 forming a predetermined gap therebetween. The temperature sensor detects the surface temperature of the fixing belt 84 immediately before entering into the fixing nip. The detection result is transmitted to a fixing power supply circuit. The fixing power supply circuit on/off controls power supply to the heat sources contained in the heating roller 83 and the pressure heating roller 81 based on the detection result.

The recording medium P having passed though the secondary transfer nip is then separated from the intermediate transfer belt 14 and fed to the fixing unit 80. The recording medium P is fed upward in FIG. 3 while being sandwiched by the fixing nip in the fixing unit 80. During this process, the recording medium P is heated and pressurized by the fixing belt 84, and the full-color toner image is fixed on the recording medium P.

The recording medium P having the fixed image thereon is passed through an ejection roller pair 87 and ejected outside the image forming apparatus 500. On the top surface of the housing of the image forming apparatus 500, a stack part 88 is formed. The recording media P ejected by the ejection roller pair 87 are successively stacked on the stack part 88.

Above the transfer unit 60, four toner cartridges 100Y, 100C, 100M, and 100K accommodating yellow toner, cyan toner, magenta toner, and black toner, respectively, are disposed. The yellow, cyan, magenta, and black toners accommodated in the respective toner cartridges 100Y, 100C, 100M, and 100K are supplied to the respective developing devices 5Y, 5C, 5M, and 5K in the respective image forming units 1Y, 1C, 1M, and 1K. The toner cartridges 100Y, 100C, 100M, and 100K are detachably mountable on the image forming apparatus main body independent from the image forming units 1Y, 1C, 1M, and 1K.

Next, an image forming operation of the image forming apparatus 500 is described below.

In response to receipt of a print execution signal from an operation panel, the charging roller 4 and the developing roller 51 each get applied with a predetermined voltage or current at a predetermined timing. Similarly, the light sources in the optical writing unit 40 and the neutralization lamp each get applied with a predetermined voltage or current at a predetermined timing. In synchronization with the application of voltage or current, the photoconductor 3 is driven to rotate in a direction indicated by arrow in FIG. 3 by a photoconductor driving motor.

As the photoconductor 3 rotates in a direction indicated by arrow in FIG. 4, the surface of the photoconductor 3 is uniformly charged to a predetermined potential by the charging roller 4. The optical writing unit 40 emits the laser light L to the charged surface of the photoconductor 3 based on image information. A part of the surface of the photoconductor 3 irradiated with the laser light L is neutralized, thereby forming an electrostatic latent image.

The surface of the photoconductor 3 having the electrostatic latent image thereon is rubbed by a magnetic brush formed of the developer on the developing roller 51 at a position where the photoconductor 3 is facing the developing device 5. As a developing bias is applied to the developing roller 51, negatively-charged toner particles on the developing roller 51 are transferred onto the electrostatic latent image, thus forming a toner image. This image forming process is performed in each of the image forming units 1Y, 1C, 1M, and 1K to form yellow, cyan, magenta, and black toner images on the photoconductors 3Y, 3C, 3M, and 3K, respectively.

Thus, in the image forming apparatus 500, the developing device 5 develops the electrostatic latent image formed on the photoconductor 3 with negatively-charged toner particles based on reversal development. In the present embodiment, an N/P (i.e., negative/positive) development system (in which toner particles get adhered to low-potential regions) and a non-contact charging roller are employed, but the development and charging systems are not limited thereto.

The toner images formed on the photoconductors 3Y, 3C, 3M, and 3K are primarily transferred onto the surface of the intermediate transfer belt 14 in a sequential manner so that they get superimposed on one another on the surface of the intermediate transfer belt 14. Thus, a composite toner image is formed on the intermediate transfer belt 14.

The composite toner image ("toner image" for simplicity) formed on the intermediate transfer belt 14 is transferred onto the recording medium P which has been fed from the first sheet feeding cassette 151 or second sheet feeding cassette 152, passed through the registration roller pair 55, and fed to the secondary transfer nip. The recording medium P is once stopped by being sandwiched by the registration roller pair 55, and then fed to the secondary transfer nip in synchronization with an entry of the leading end of the toner image on the intermediate transfer belt 14 into the secondary transfer nip. The recording medium P having the transferred toner image thereon is then separated from the intermediate transfer belt 14 and fed to the fixing unit 80. As the recording medium P having the transferred toner image thereon passes through the fixing unit 80, the toner image is fixed on the transfer sheet P by heat and pressure. The transfer sheet P having the fixed toner image thereon is ejected outside the image forming apparatus 500 and stacked at the stack part 88.

On the other hand, after the toner image has been transferred from the surface of the intermediate transfer belt 14 onto the recording medium P in the secondary transfer nip, the belt cleaning unit 162 removes residual toner particles remaining on the surface of the intermediate transfer belt 14.

Similarly, after the toner image has been transferred from the surface of the photoconductor 3 onto the intermediate transfer belt 14 in the primary transfer nip, the cleaning device 6 removes residual toner particles remaining on the surface of the photoconductor 3. The lubricant applicator 10 then applies a lubricant to the cleaned surface, and the neutralization lamp further neutralizes the surface.

As illustrated in FIG. 4, each of the image forming units 1 of the image forming apparatus 500 has a frame body 2 accommodating the photoconductor 3 and the processing devices including the charging roller 4, the developing device 5, the cleaning device 6, and the lubricant applicator 10. The image forming units 1 is temporarily detachable from the main body of the image forming apparatus 500 as a process cartridge. Thus, in the image forming apparatus 500, the photoconductor 3 and the processing devices are replaceable at the same time by replacing the image forming unit 1 as the process cartridge. Alternatively, each of the photoconductor 3, the charging roller 4, the developing device 5, the cleaning device 6, and the lubricant applicator 10 may be independently replaceable.

Process Cartridge

A process cartridge according to an embodiment of the present invention includes an image bearer and a cleaning device to remove a residue (e.g., toner) remaining on the surface of the image bearer, and may optionally include other devices as necessary.

The cleaning device includes the cleaning blade according to an embodiment of the present invention.

The process cartridge is a device (part) that is detachably mountable on an image forming apparatus, which contains an image bearer and the cleaning blade according to an embodiment of the present invention inside, and at least one of a charger, an irradiator, a developing device, and a transfer device.

EXAMPLES

Further understanding can be obtained by reference to certain specific examples which are provided herein for the purpose of illustration only and are not intended to be limiting. In the following descriptions, "parts" represents "parts by mass" unless otherwise specified.

Example 1

Elastic Body

As an elastic body, a polyurethane elastomer sheet was prepared by centrifugal molding. The properties, i.e., average thickness (i.e., film thickness), JIS-A hardness, rebound resilience at 23° C., and Martens hardness (HM), of the sheet are as described below.

Average thicknesses: 1.8 mm

JIS-A Hardness: 70 degrees

Rebound resilience at 23° C.: 50%

Martens hardness (HM): 1.0 N/mm$^2$

Measurement of JIS-A Hardness

The JIS-A hardness of the elastic body was measured at 23° C. using a micro rubber durometer (MD-1, product of Kobunshi Keiki Co., Ltd.) according to JIS K6253.

Measurement of Rebound Resilience of Elastic Body

The rebound resilience of the elastic body was measured at 23° C. using a resilience tester (No. 221, product of Toyo Seiki Seisaku-sho. Ltd.) according to JIS K6255. As the measurement specimen, a laminate in which sheets each having a thickness of 2 mm were laminated to have a total thickness of 4 mm or more was used.

Measurement of Martens Hardness

The Martens hardness (HM) of the elastic body was measured according to ISO 14577 using a nanoindenter (ENT-3100, product of ELIONIX INC.) by pushing a Berkovich indenter into a sample with a load of 1,000 μN for 10 seconds, holding for 5 seconds, and pulling the indenter with the same loading rate for 10 seconds.

The measurement was performed at a position 20 μm away from the tip edge portion of the blade-shaped sheet after molding.

Processing into Cleaning Blade

The above-prepared polyurethane elastomer sheet (simply "urethane sheet") was subjected to post-curing for completing the curing reaction occurring therein to eliminate unreacted materials from the urethane sheet, and further to curing for stabilizing physical properties, then bonded to a holder to become a cleaning blade.

Preparation of Coating Layer

A particle dispersion was prepared using 4 parts of polytetrafluoroethylene (PTFE) micropowder (TF9201Z, product of 3M Company, having a volume average particle diameter of 200 nm) as fluorine-based particles, 1.9 parts of a VdF-HFP-TFE terpolymer that in which VdF, HFP, and TFE were copolymerized at a molar ratio of 80%, 10%, and 10%, 0.1 parts of a perfluoroether-based fluorine oil (PT-53, product of NICCA CHEMICAL CO., LTD., having a molecular weight of 3,500), and 94 parts of a fluorine-containing organic solvent 1,1,2,2-tetrafluoroethyl 2,2,2-trifluoroethyl ether: HFE-347 (T3057, product of Tokyo Chemical Industry Co., Ltd.).

Specifically, in this preparation procedure for the particle dispersion, the terpolymer and the fluorine oil were sufficiently dissolved in HFE-347, then the fluorine-based particles were added thereto, and the mixture was further stirred and mixed.

Figure 5:
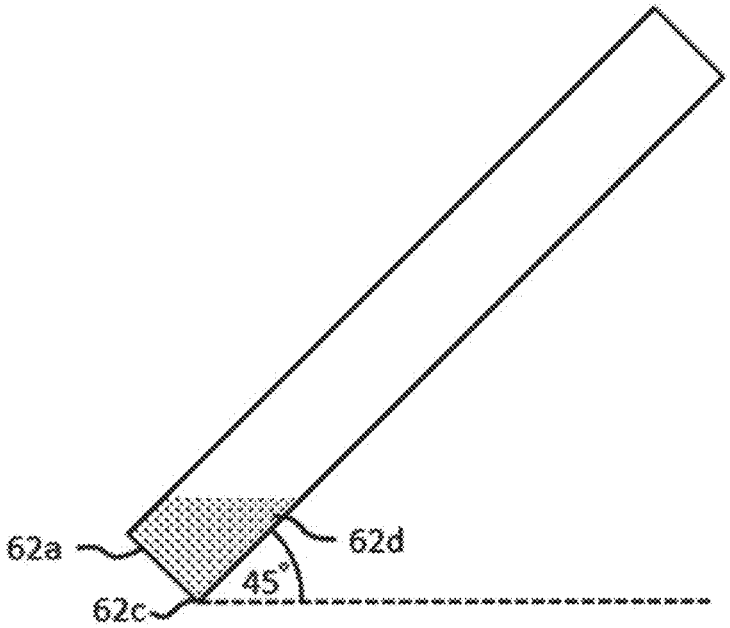
FIG. 5 is a schematic diagram for explaining a method of forming a coating layer performed in the Examples of the present disclosure.

Next, the cleaning blade was immersed in the particle dispersion by a depth of 2 mm from the blade tip face and pulled up at a pull-up speed of 1 mm/s. After that, the cleaning blade was tilted by about 45°, as illustrated in FIG. 5, and dried at room temperature for 30 minutes for collecting the fluorine-based particles made of PTFE in the blade tip portion 62*c* (including the contact edge) for imparting the cleaning function, thereby producing a cleaning blade of Example 1.

Examples 2 to 6 and Comparative Examples 1 to 4

Cleaning blades of Examples 2 to 6 and Comparative Examples 1 to 4 were produced in the same manner as in Example 1, except that the conditions were changed to those presented in Table 1.

A cleaning blade of Comparative Example 1 is composed only of an elastic body without a coating layer.

A cleaning blade of Comparative Example 2 contains only spherical particles (PMMA having an average particle diameter of 1.5 μm) in the coating layer.

A cleaning blade of Comparative Example 3 contains only an oil (silicone oil KF-96-50cs, product of Shin-Etsu Chemical Co., Ltd.) in the coating layer.

A cleaning blade of Comparative Example 4 was produced with reference to Example 1 of Japanese Patent No. 3201949, in which polyvinylidene fluoride (PVdF) was used as the fluorine-based resin and xylene hexafluoride HCFC-225 was used as the fluorine-containing organic solvent.

TABLE 1

| | | Examples | | | | | | Comparative Examples | | | |
|---|---|---|---|---|---|---|---|---|---|---|---|
| | | 1 | 2 | 3 | 4 | 5 | 6 | 1 | 2 | 3 | 4 |
| Spherical Particles | Type | PTFE | PTFE | PTFE | PTFE | PTFE | PTFE | — | PMMA | — | PTFE |
| | Particle Diameter [μm] | 0.2 | 0.2 | 0.12 | 0.12 | 0.2 | 0.2 | — | 1.5 | — | 0.2 |
| | Addition Amount [part] | 4 | 4 | 5 | 5 | 4 | 4 | — | 100 | — | 5 |
| Fluorine-based Oil | Type | PT-53 | PT-53 | PT-02 | PT-82 | PT-53 | PT-53 | — | — | Silicone Oil KF-96-50cs | — |
| | Molecular Weight | 3500 | 3500 | 2000 | 2800 | 3500 | 3500 | — | — | — | — |
| | Addition Amount [part] | 0.1 | 0.1 | 0.1 | 0.1 | 0.1 | 0.1 | — | — | 100 | — |
| VdF-HFP-TFE Terpolymer | VdF [mol %] | 80 | 70 | 60 | 60 | 30 | 60 | — | — | — | PVdF |
| | HEP [mol %] | 10 | 15 | 20 | 20 | 35 | 35 | — | — | — | |
| | TFE [mol %] | 10 | 15 | 20 | 20 | 35 | 5 | — | — | — | |
| | Addition Amount [part] | 1.9 | 1.9 | 2 | 2 | 9 | 1.9 | — | — | — | 5 |
| Fluorine-containing Organic Solvent HFE347 | Addition Amount [part] | 94 | 94 | 92.9 | 92.9 | 93.9 | 94 | — | — | — | HCFC-22590 |

Assembly of Image Forming Apparatus

Each cleaning blade was mounted on a process cartridge of a color multifunction peripheral (IMAGIO MP C4500), product of Ricoh Co. Ltd.), the printer part of which having the same configuration as the image forming apparatus 500 illustrated in FIG. 3, to assemble an image forming apparatus.

The cleaning blade was mounted on the image forming apparatus with a linear pressure of 20 g/cm and a cleaning angle of 79°.

Evaluation of Torque

The above-prepared imaging apparatus was made to produce output under the following conditions. During the output, the driving torque of the photoconductor was measured. After the output, the tip portion of the cleaning blade was observed with a laser microscope (LEXT OLS4500, product of Olympus Corporation), and the torque was evaluated based on the following criteria. The evaluation results are presented in Table 2. The "initial value" defined in the evaluation criteria refers to the value obtained in the initial stage in which the 1st to 500th sheets were output.

Environment: 23° C./45% RH

Output condition: White sheet chart

Number of output sheets: 5,000 sheets (A4-size lateral)

Evaluation Criteria

A: The rate of change in torque increase was within 50% of the initial value, and the photoconductor did not stop due to an increase in driving torque. The blade was observed to have no trace of turning-up even after printing.

B: The rate of change in torque increase was within 50% of the initial value, and the photoconductor did not stop due to an increase in driving torque. The blade was observed to have a trace of turning-up after printing, but it was not at such a level that the blade allowed the toner to pass through. No problem in practical use.

C: The photoconductor stopped due to an increase in torque. The blade was observed to have a trace of turning-up after printing to such an extent that the toner passed through the blade. Not suitable for practical use.

Evaluation of Cleaning Performance

The above-prepared imaging apparatus was made to produce output under the following conditions. After that, the edge portion of the cleaning blade and the surface of the photoconductor were observed with the above-described laser microscope and evaluated based on the following evaluation criteria. The evaluation results are presented in Table 2.

Environment: 27° C./80% RH

Output condition: 3 prints/job of a chart having an image area ratio of 5%

Number of output sheets: 50,000 sheets (A4-size lateral)

Evaluation Criteria

A: Toner particles having slipped through due to defective cleaning are not visually confirmed on either the print sheet or the photoconductor, and no streak-like toner slippage is confirmed even when the photoconductor is observed with a microscope in the longitudinal direction.

B: Toner particles having slipped through due to defective cleaning are not visually confirmed on either the print sheet or the photoconductor.

C: Toner particles having slipped through due to defective cleaning are visually confirmed on either the print sheet or the photoconductor.

TABLE 2

| | Examples | | | | | | Comparative Examples | | | |
|---|---|---|---|---|---|---|---|---|---|---|
| | 1 | 2 | 3 | 4 | 5 | 6 | 1 | 2 | 3 | 4 |
| Evaluation of Torque | A | B | A | A | B | B | C | C | C | C |
| Evaluation of Cleaning Performance | B | B | A | A | B | A | C | C | C | C |

Comparing Example 1 and Example 2, the proportion of HFP in Example 2 is higher than that in Example 1. As the proportion of HFP increases, the hardness decreases, and the binder became softer. Thus, the binder acted in a disadvantageous manner in the evaluation of torque, and the result was B rank, not A rank.

In Example 6, the binder was the softest, and the evaluation result of torque was B rank. In the evaluation of cleaning performance, such a softer binder was able to follow the movement of the tip portion of the cleaning blade, and the result was rank A. By contrast, in Comparative Example 1, the cleaning blade was made only of an elastic body, and p was high, so that both of the evaluation results were C ranks.

In Comparative Example 2, the cleaning blade was not able to maintain a low sliding effect due to the absence of a binder although fine particles were present, resulting in C ranks in both of the evaluations.

In Comparative Example 3, due to the absence of a binder although the silicone oil was present, both of the evaluation results were C ranks for the same reason as in Comparative Example 2.

In Comparative Example 4, PTFE particles and PVdF as the binder were present. However, PVdF, which was a crystalline resin, was broken and peeled off by the behavior of the tip portion of the cleaning blade, and made it difficult to maintain a low sliding effect, resulting in C ranks in both of the evaluations.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A cleaning blade comprising:

an elastic body having a contact edge to contact a surface of a cleaning target to remove a residue on the surface, the elastic body including a coating layer on at least a part of the contact edge, the coating layer containing: fluorine-based particles; and a binder comprising a fluorine-based oil.

2. The cleaning blade according to claim 1, wherein the fluorine-based particles comprise polytetrafluoroethylene particles.

3. The cleaning blade according to claim 2, wherein the polytetrafluoroethylene particles have a volume average particle diameter of 1 μm or less.

4. The cleaning blade according to claim 1, wherein the binder further comprises a fluorine-based resin.

5. The cleaning blade according to claim 4, wherein the fluorine-based resin comprises a VdF-HFP-TFE terpolymer of vinylidene fluoride (VdF), hexafluoropropylene (HFP), and tetrafluoroethylene (TFE).

6. The cleaning blade according to claim 5, wherein proportions of the VdF, HFP, and TFE in the VdF-HFP-TFE terpolymer are 30% to 85% by mol, 10% to 35% by mol, and 5% to 35% by mol, respectively.

7. The cleaning blade according to claim 1, wherein the fluorine-based oil has a weight average molecular weight of from 2,000 to 3,500.

8. A process cartridge comprising:

an image bearer;

at least one of:

a charger to charge a surface of the image bearer;

an irradiator to irradiate the charged surface of the image bearer to form an electrostatic latent image;

a developing device to develop the electrostatic latent image into a toner image; or a transfer device to transfer the toner image onto a recording medium; and a cleaning device to contact the surface of the image bearer to remove a residue on the surface of the image bearer, the cleaning device comprising the cleaning blade according to claim 1.

9. An image forming apparatus comprising:

an image bearer;

a charger to charge a surface of the image bearer;

an irradiator to irradiate the charged surface of the image bearer to form an electrostatic latent image;

a developing device to develop the electrostatic latent image into a toner image;

a transfer device to transfer the toner image onto a recording medium;

a fixing device to fix the transferred toner image on the recording medium; and a cleaning device to contact the surface of the image bearer to remove a residue on the surface of the image bearer, the cleaning device comprising the cleaning blade according to claim 1.

* * * * *